US008844219B2

(12) United States Patent
Neal

(10) Patent No.: US 8,844,219 B2
(45) Date of Patent: Sep. 30, 2014

(54) PRIMARY FRAMING SYSTEM AND A METHOD OF INSTALLATION

(75) Inventor: Murray L. Neal, Fresno, CA (US)

(73) Assignee: American Development Group International, LLC, Washington, DC (US)

( * ) Notice: Subject to any disclaimer, the term of this patent is extended or adjusted under 35 U.S.C. 154(b) by 263 days.

(21) Appl. No.: 10/788,716

(22) Filed: Feb. 27, 2004

(65) Prior Publication Data

US 2005/0188631 A1 Sep. 1, 2005

(51) Int. Cl.

| | |
|---|---|
| ***E06B 3/673*** | (2006.01) |
| ***E06B 5/10*** | (2006.01) |
| ***E06B 5/12*** | (2006.01) |
| *E06B 1/02* | (2006.01) |
| *E06B 1/16* | (2006.01) |
| *E06B 1/04* | (2006.01) |
| *E06B 1/36* | (2006.01) |
| *E06B 3/30* | (2006.01) |

(52) U.S. Cl.

CPC . *E06B 5/106* (2013.01); *E06B 1/02* (2013.01); *E06B 1/16* (2013.01); *E06B 1/04* (2013.01); *E06B 1/363* (2013.01); *E06B 3/305* (2013.01); *E06B 5/12* (2013.01)

USPC .... 52/204.62; 52/208; 52/204.57; 52/204.61; 52/214

(58) Field of Classification Search

CPC ..... E06B 1/02; E06B 1/16; E06B 1/18; E06B 1/26; E06B 1/28; E06B 1/30; E06B 3/673; E06B 3/4415; E06B 3/66

USPC ..... 52/204.5, 208, 204.55, 214, 204.62, 52/204.57, 204.61

See application file for complete search history.

(56) References Cited

U.S. PATENT DOCUMENTS

| | | | | |
|---|---|---|---|---|
| 2,757,421 | A * | 8/1956 | Toney | 52/204.55 |
| 2,791,007 | A * | 5/1957 | Kobil et. al. | 52/212 |
| 2,949,981 | A * | 8/1960 | Ferrell | 52/235 |
| 3,016,993 | A * | 1/1962 | Owen | 52/204.591 |
| 3,203,053 | A * | 8/1965 | Lane et. al. | 52/212 |

(Continued)

FOREIGN PATENT DOCUMENTS

| | | |
|---|---|---|
| DE | 37 00 202 A1 | 7/1988 |
| DE | 89 02 232 U | 8/1989 |
| EP | 0 436 868 A2 | 7/1991 |
| WO | WO 86/01249 | 2/1986 |

OTHER PUBLICATIONS

Technology Assessment Program, "Ballistic Resistant Protective Materials—NIJ Standard 0108.01", U.S. Department of Justice, National Institute of Justice, Sep. 1985 (16 pgs.).

(Continued)

*Primary Examiner* — Phi A

(74) *Attorney, Agent, or Firm* — Antoinette M. Tease

(57) ABSTRACT

A window framing system has multiple pieces that are components of a primary frame. The pieces are pre-formed, and may be assembled so as to build the frame at a job site. The pieces include a sub-frame and a base. The sub-frame has a corner to receive a glazing unit. The base is to be assembled with the sub-frame so as to secure the glazing unit in the corner. Other embodiments are also described and claimed.

19 Claims, 12 Drawing Sheets

HEAD/SILL/JAMB WITH AESTHETIC COVER CAP

(56) References Cited

U.S. PATENT DOCUMENTS

| | | | | | |
|---|---|---|---|---|---|
| 3,205,630 | A | * | 9/1965 | Felix et. al. | 52/476 |
| 3,858,375 | A | * | 1/1975 | Silvernail | 52/235 |
| 4,055,923 | A | * | 11/1977 | Biebuyck | 52/235 |
| 4,115,964 | A | * | 9/1978 | Montrouil | 52/106 |
| 4,251,964 | A | | 2/1981 | Francis | |
| 4,525,966 | A | * | 7/1985 | Litchfield et al. | 52/204.591 |
| 4,715,152 | A | * | 12/1987 | Tanikawa | 52/209 |
| 4,773,193 | A | * | 9/1988 | Biebuyck et al. | 52/93.1 |
| 4,803,809 | A | * | 2/1989 | Takemura | 49/404 |
| 4,803,820 | A | * | 2/1989 | Metrick | 52/204.591 |
| 5,036,637 | A | * | 8/1991 | Biebuyck | 52/235 |
| 5,596,851 | A | * | 1/1997 | Ting | 52/211 |
| 5,746,032 | A | * | 5/1998 | Koike et al. | 52/204.1 |
| 6,088,979 | A | | 7/2000 | Neal | |
| 6,158,182 | A | * | 12/2000 | Biebuyck | 52/235 |
| 6,182,405 | B1 | * | 2/2001 | Lindahl | 52/204.1 |
| 6,698,154 | B2 | * | 3/2004 | Vance | 52/716.6 |
| 6,715,248 | B2 | * | 4/2004 | Biebuyck | 52/235 |
| 6,993,873 | B2 | * | 2/2006 | Biebuyck et al. | 52/235 |
| 2002/0095885 | A1 | * | 7/2002 | Sampson | 52/202 |

OTHER PUBLICATIONS

UL Standard for Safety, "Bullet-Resisting Equipment, UL 752", Ninth Edition, Underwriters Laboratories, Inc., Northbrook, IL, ISBN 1-55989-714-7, Jan. 27, 1995 (16 pgs.).

US General Services Administration (GSA), "Standard Test Method for Glazing and Glazing Systems Subject to Airblast Loadings[1]", (Modified Version of ASTM 1642-96) (pp. 1-4).

* cited by examiner

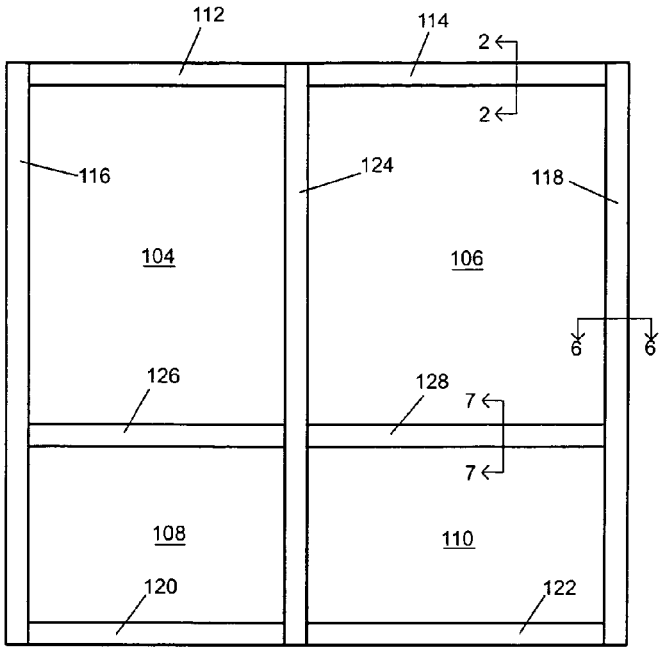
Fig. 1
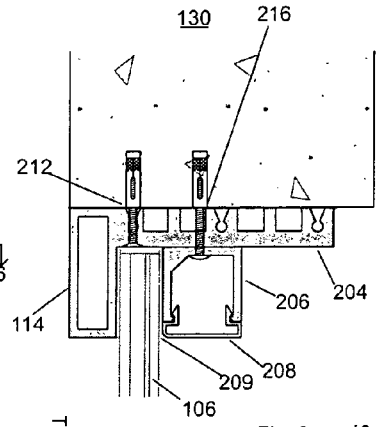
HEAD Fig. 2
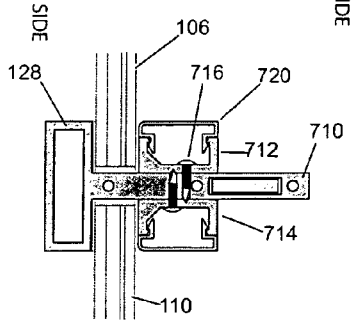
MULLION Fig. 7
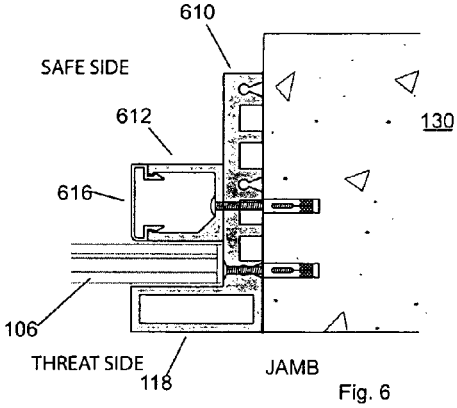
Fig. 6
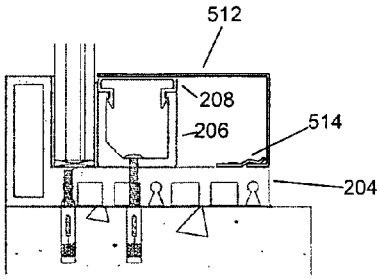
HEAD/SILL/JAMB WITH AESTHETIC COVER CAP Fig. 5
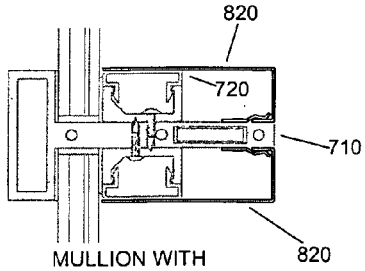
MULLION WITH AESTHETIC COVER CAP Fig. 8

FRONT SLEEVE ANCHOR PLACEMENT

REAR SLEEVE ANCHOR PLACEMENT

PRIMARY FRAMING SYSTEM AND A METHOD OF INSTALLATION

BACKGROUND

An embodiment of the invention relates generally to frames that support glazings for windows, and more specifically, to an improved primary frame for supporting security glazings, i.e. glazings that are designed to mitigate explosive blasts, be ballistic resistant, or resist forced entry threats. Other embodiments are also described and claimed.

In an increasingly violent society, businesses and government institutions are subject to a greater number of threats against both life and property. Such threats may be in the form of ballistic threats, explosive blasts, forced entries, as well as others. Security measures have been taken to protect against such threats. These include the installation of special windows that have increased strength, to withstand an attack. For example, windows that have security glazings that can resist certain explosive blasts, ballistic threats, and/or forced entry threats are being specified in new commercial, as well as industrial buildings. Such windows may also present better resistance to natural disasters such as hurricanes, tornadoes, and severe storms.

Conventional windows that call for security glazings have a primary frame to secure a glazing unit, within a defined casement opening of a building, for example. The frame is referred to as a "primary" frame because it may be the only frame that is needed to close the given opening between a "threat side" and a "safe side". Where the threat side is outside of the building, and the safe side is inside the building, the primary frame serves not only to secure the glazing, but to also weatherproof the opening. A conventional method for installing a primary, ballistic resistant glazing frame involves pre-welding four L-shaped pieces of solid steel that are sized to fit a given opening of the building and then bringing the welded sub-frame to the job site, anchoring this welded sub-frame to the building material that surrounds the opening (such as a sill, king studs, and a header), placing the glazing unit against the secured sub-frame, and then anchoring four pieces of square, tubular steel glazing stop to all four sides of the sub-frame to secure the glazing in place.

BRIEF DESCRIPTION OF THE DRAWINGS

The embodiments of the invention are illustrated by way of example and not by way of limitation in the figures of the accompanying drawings in which like references indicate similar elements. It should be noted that references to "an" embodiment of the invention in this disclosure are not necessarily to the same embodiment, and they mean at least one.

FIG. 1 is a diagrammatic elevation view of an embodiment of the primary frame as assembled.

FIG. 2 is a sectional view of a head region of the frame, along line 2-2 of FIG. 1, as attached in this example to concrete building material.

FIG. 5 shows a sectional view of a head, sill, or jamb region of the frame with an aesthetic cover cap.

FIG. 6 illustrates a sectional view of a jamb region along line 6-6 of FIG. 1, as attached in this example to concrete building material.

FIG. 7 is a sectional view along line 7-7 of a horizontal mullion.

FIG. 8 is a sectional view of a mullion fitted with a further aesthetic cover cap on both sides of a mullion sub-frame.

DETAILED DESCRIPTION

Figure 3:
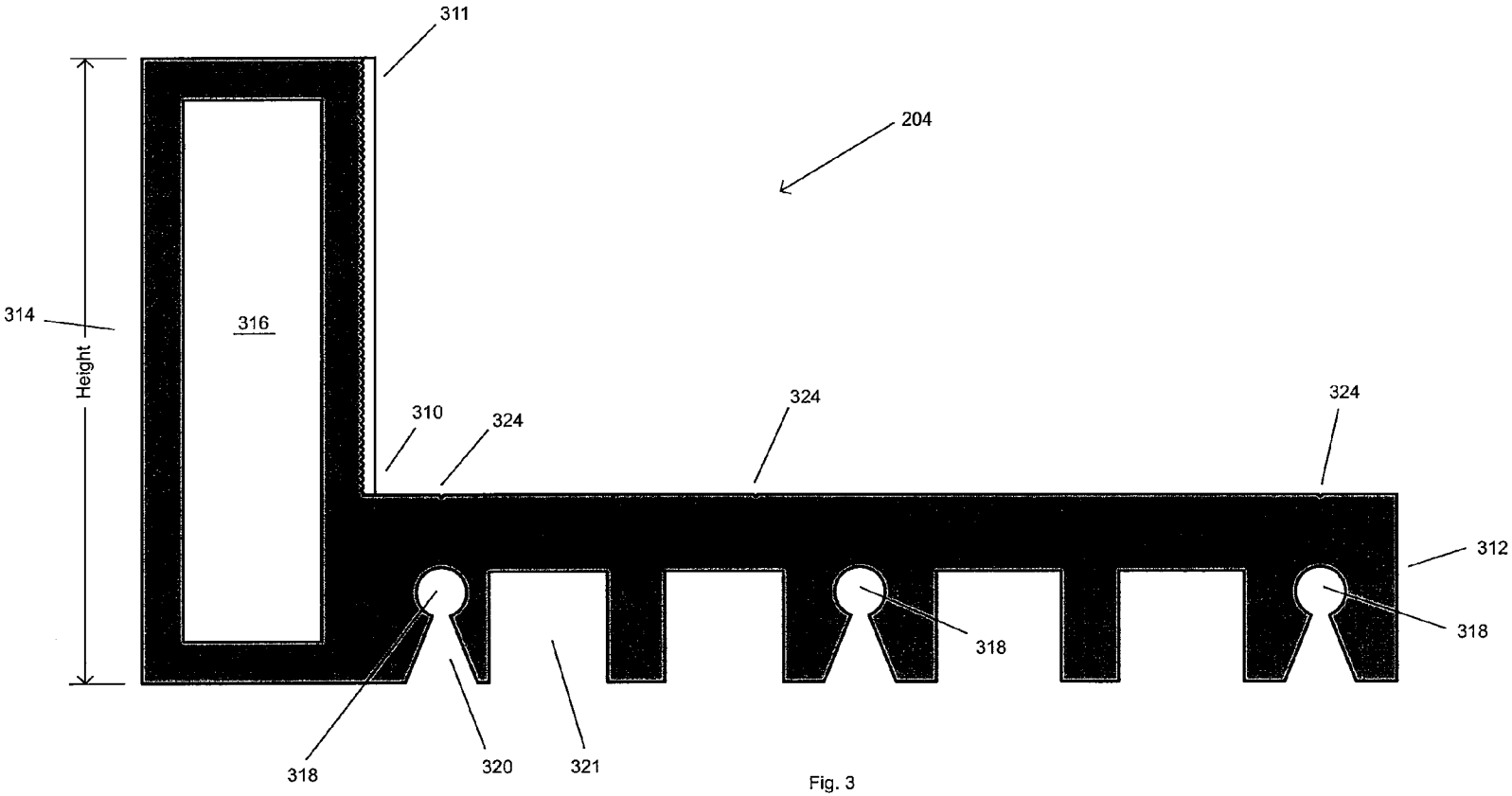
FIG. 3 is a close up sectional view of a sub-frame.

A disadvantage associated with the conventional security windows described above is the relatively high cost associated with pre-forming a welded steel sub-frame (of a primary frame). According to an embodiment of the invention, a window framing system has a number of separate pieces that are structural components of a primary frame, where the pieces are preformed and are to be assembled so as to build the frame at the job site. The pieces may be cut off a preformed beam of extruded aluminum (either at the job site or delivered as cut to the site). No welding is necessary in cases where the pieces are assembled by fasteners, such as screws. The pieces may also be assembled into an entire frame held together by screws (a screw splined system), without having to weld the pieces together. For higher threat applications, reinforcing strips made of steel and/or aluminum, for example, may be added into preformed cavities of the pieces.

The primary frame may be the only one that closes an opening of a building between a threat side and a safe side. Where the threat side is defined to be outside of the building, the assembled primary frame can provide the needed weather seal/proofing, and should be designed to have the required depth so as to cover the casement area of the opening. The structural pieces that make up the primary frame are composed of a base and a sub-frame for each side of the frame, and may be used to easily secure security glazings of different thicknesses. Additional embodiments will be described below.

Beginning with FIG. 1, this figure is a diagrammatic elevation view of an embodiment of the primary frame as assembled. In this embodiment, the frame is designed to support four glazing units 104, 106, 108, and 110. The perimeter of the frame consists of horizontally oriented pieces 112 and 114 at the head, vertically oriented pieces 116 and 118 at opposing jambs, and horizontal pieces 120 and 122 at the sill. In this particular version, a vertically oriented mullion 124 splits the frame in half and serves to support on one side glazings 104 and 108 and on the other side glazings 106 and 110. In addition, two separate horizontal mullions 126 and 128 are provided to complete the structural components of the frame. In other versions, such as a single pane punch window, no mullions are used. The frame may be installed into a casement or door opening surrounded by building material 130. The building material 130 may be made of concrete, masonry, wood, or steel structures typically used in commercial or industrial type buildings, for example. Other applications of the framing system include curtain walls.

Turning now to FIG. 2, a sectional view of the head region of the frame, along line 2-2 of FIG. 1, is shown. The head piece 114 in this embodiment includes a sub-frame 204 and a base 206. The sub-frame 204 is secured to the building material 130 by means of a fastener such as a concrete sleeve anchor 212. The anchor 212 may be flat headed to provide a flush surface for the end of the glazing unit 106 to rest against. The sub-frame 204 can be seen to have a corner that receives the glazing unit 106. The base 206, when assembled as shown, secures the glazing unit 106 in the corner. The base and sub-frame may be used to secure glazings of different thicknesses, by for example, adjusting the position of the base 206 backwards (that is to the right in FIG. 2) towards the safe side of the frame so as to accommodate a thicker glazing, and then anchoring the base 206 to the building material 130 behind it. The anchoring in this embodiment also uses a fastener being a concrete sleeve anchor 216 to secure the base through the sub-frame 204 to the building material 130, which in this embodiment is essentially concrete. Other building materials such as masonry, wood and/or steel studs can also work. The appropriate fastener should be used in those cases, e.g. a pointed wood screw or a self-drilling screw, either flat, pan headed, or bolt/nut combination as appropriate.

Note that the size, number and placement of the fasteners used for securing the sub-frame 204 and the base 206, should be selected to preferably meet popular blast mitigation threats per the ASTM F 1642-96 Standard Test Method for Glazings and Glazing Systems Subject to Airblast loadings. In addition, or as an alternative, the selections may be designed to help the primary frame meet ballistic requirements, such as those in Underwriters' Laboratories (UL) 752 Standard for Bullet-Resistant Equipment, Ninth Edition, Jan. 27, 1995, Level 8; National Institute of Justice (NIJ) Standard for Ballistic Resistant Protective Materials 0108.01 (September 1985); and forced entry threats under ASTM F 1233-93 Test Method for Security Glazing Materials and Systems, Class IV, Sequence 27.

The framing system may also include an aesthetic "snap" cap 208 designed to for example snap on to the base 206 which, in this embodiment, is substantially U-shaped to support the snap cap 208. The cap 208 has a rounded front edge 209 that faces the glazing unit 106, so as to reduce the chances of the glazing being scored during flexing (thus avoiding premature failure or breakage of the glazing).

Referring now to FIG. 3, a close up sectional view of an embodiment of the sub-frame 204 is shown. The sub-frame 204 has an elongated portion (running lengthwise, perpendicular to the page) with a substantially L-shaped cross-section that defines a corner 310. A first segment 312 is to be secured to a head, jamb, or sill at the job site. A set of grooves 321 that run lengthwise through the segment 312 may be formed, to reduce weight. A second segment 314 has a cavity 316 therein that also runs lengthwise, through a substantial part of the elongated portion. A piece of double-sided adhesive tape 311 may be attached to the surface of the second segment 314, against which a glazing unit will rest. As an alternative to the tape 311, a structural liquid adhesive may be applied which may act not just as a weather seal but also as a means for retaining the glazing. As will be further discussed below, the cavity 316 serves to not only reduce the weight of the sub-frame 204, but may also be sleeved with strips of armor grade material that will further reinforce the frame against ballistic threats. The height of a preferred version of the sub-frame is about 2½ inches. The other dimensions in FIG. 3 may be easily determined based on this given height, because the drawing is to scale.

The sub-frame 204 also has a number of screw holes 318 that are formed lengthwise in the first segment 312, as shown. These screw holes are to receive and grip corresponding screws that will be used to secure the sub-frame 204 to an abutting sub-frame (not shown). The holes 318 may be part of a screw spline system for assembling the primary frame, and are particularly effective for meeting certain blast threats. The holes 318 communicate with triangular cross-section shaped openings 320 that allows material which has been cut, due to a screw being driven into the hole 318, to exit so as not to fill up the hole. This allows a screw to tap through the hole 318 relatively easily when assembling the frame. Note that the sub-frame 204 may also be manufactured with notches 324 aligned with their corresponding holes 318. These notches show where to drill holes into the sub-frame 204, so as to align the newly drilled holes with corresponding holes 318 of another abutting piece (not shown). For example, the abutting piece may be the vertical mullion 124 or the jamb piece 118 shown in FIG. 1.

Referring briefly back to FIG. 2, the sub-frame 204 has a corner in which to receive the glazing unit 106 as shown, from the safe side. A base 206, that is to be assembled with the sub-frame to secure the glazing unit in place, is depicted in a close up sectional view in FIG. 4. The base 206 also has an elongated portion (lengthwise, perpendicular to the page) with an L-shaped cross-section 410 whose first segment 412 has a piece of double-sided adhesive tape 415 that also attaches to the glazing that is being secured in a corner of the sub-frame 204. As an alternative to the tape 415, a structural liquid adhesive may be applied to retain the glazing. A second segment 414 is to be secured to the segment 312 of the sub-frame 204 (see FIG. 3). The first and second segments 412, 414 may lead into a fillet 413, with a chamfer 417 at a corner as shown. The fillet 413 and the chamfer 417 increase the strength of the base to better withstand pressure from the threat side (e.g., due to a blast attack).

Figure 4:
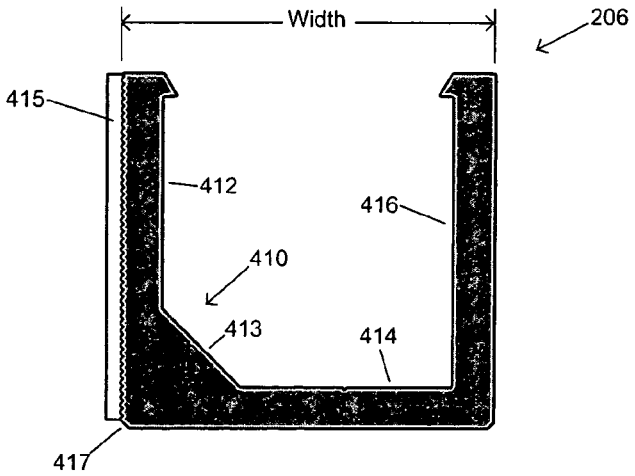
FIG. 4 depicts a close up sectional view of a base that is to be assembled with the sub-frame.

In addition to the L-shaped cross-section 410, this embodiment of the base 206 has a further upright section 416 that gives the overall base 206 a substantially U-shape. A purpose of the upright section 416 is to provide support for the aesthetic snap cap 208 to be snap fitted (see FIG. 2). The snap cap 208 once installed substantially hides the first and second segments 412, 414 of the base, as well as the heads of the fasteners (e.g., the anchor screw 216, see FIG. 2) from view. Note that, as an example, the width of the base 206 may be about 1.5 inches, with the rest of the dimensions being related (as the illustration in FIG. 4 is to scale).

FIG. 5 shows a sectional view of an embodiment of the invention where a further aesthetic "cover" cap 512 has been positioned into place to cover not only the entire base 206 and the snap cap 208, but also a top part of the sub-frame 204. A clip 514 has, in this embodiment, been riveted on to the top surface of the sub-frame 204, and is used to hold in place an extruded aluminum, substantially L-shaped piece, with a short return at one end, that forms the aesthetic cap 512. Such a cover cap 512 hides from view the two-stepped frame, thereby providing an architecturally cleaner look. Note that the two piece solution of the snap cap 208 and cover cap 512 may be relatively low cost because the pieces can be cut to size from separate, extruded aluminum beams. In addition, pieces from the same extrusion may be used with glazing units that have different thickness. An alternative solution is to have a single piece cap that integrates both the snap cap 208 and cover cap 512. However, that may require different extrusions, for different thickness glazing units.

The elevation view in FIG. 1 also shows a cut line 6-6 through the vertical jamb piece 118 that is secured to a jamb. A sectional view along this cut line is illustrated in FIG. 6. The section view of the jamb piece 118 shows that a sub-frame 610, which is vertically oriented, is secured directly to the surface of a jamb of the building material 130 being, in this case, concrete. The glazing unit 106 rests against the corner formed in the sub-frame 610, and is held in place by a base 612. Once again, a cap 616 may be snap fitted over the base 612 for a more desirable architectural look. In this embodiment, as the one in FIG. 2, the threat side, which is the side from which an explosive blast or other attack is expected, is said to be "forward" of the sub-frame 610, while the area "behind" the glazing 106 is considered the safe side or protected area.

In an embodiment of the invention, essentially the same type of sub-frame and base can be used for the jamb region, the head region, and the sill region of the primary frame. This allows the base and sub-frame pieces to be cut from the same, respective preformed beam of extruded aluminum, thereby providing for significant cost savings in the manufacture and installation of the frame as a whole. A sectional view of the horizontal piece 122 or 120 at the sill would be essentially identical to that shown in FIG. 2, but flipped over a horizontal axis.

Referring back to the elevation view of FIG. 1, the primary frame shown here also has, in addition to the head, sill and jamb pieces described above, a pair of horizontal mullions 126, 128 and a single vertical mullion 124. A sectional view along the line 7-7 of the horizontal mullion 128 is illustrated in FIG. 7. The mullion includes a sub-frame 710, a first base 712, and a second base 714. The mullion bases 712, 714 may be substantially identical to the base 206 depicted in FIG. 4 (for a perimeter piece), except that the mullion base need not be as tall. In addition to having a certain aesthetic appeal, a shorter mullion base also helps promote a desirable failure mechanism for the primary frame, in the face of a blast attack. Using such a mullion base that has a smaller "bite" (to retain the glazing unit) may allow the glazing unit to be forced out of its pocket initially at a mullion, rather than at a perimeter piece (during a blast attack).

The mullion sub-frame 710 has respective corners that are to receive the glazing units 106 and 110, respectively. The bases 712 and 714 are to be assembled as shown, so as to secure the glazings 106, 110 in their respective corners. Fasteners, in this case screws 716, are passed through the base and into a stem portion of the sub-frame, T-shaped cross-section as shown. Once again, aesthetic snap caps 720 may be fitted to both sides of the mullion, so as to hide from view the screws 716, as well as hide the interior cavity of the U-shaped bases 712, 714.

The mullion is useful where the opening to be framed is so large that multiple glazing units may be needed to cover it. Another advantage of using the mullion is that it allows explosive blast and/or ballistic grade glazing units that are relatively heavy and expensive to be replaced individually after an attack, to avoid the expense associated with replacing a single, large glazing unit. As shown in FIG. 1, the mullion may be horizontally oriented (ref. 128), or it may be vertically oriented (ref. 124). A sectional view of the vertical mullion 124 would be essentially identical to that of FIG. 7, as rotated clockwise by 90°.

A mullion may be fitted with a further aesthetic cover cap 820 on both sides of the sub-frame 710, as illustrated in FIG. 8. The cover cap 820 thus hides the two stepped aspect of the mullion, thereby giving an architecturally streamlined look. As an alternative to the twin piece solution shown, the cover cap 820 may be integrated with the snap cap 720 into a single, extruded piece.

Figure 9:
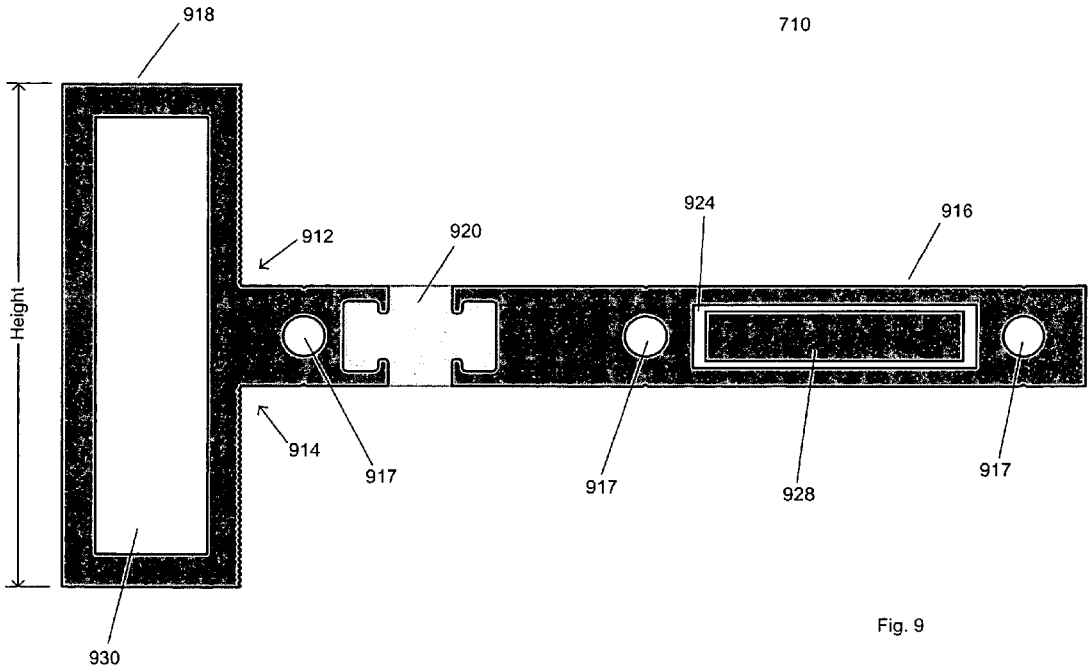
FIG. 9 shows an enlarged sectional view of a mullion sub-frame having a thermal break.

Turning now to FIG. 9, an enlarged view of a mullion sub-frame 710 is shown in cross-section. The mullion sub-frame 710 has an elongated portion (lengthwise, perpendicular to the page) that has a substantially T-shaped cross-section as shown. Respective corners 912, 914 are formed on opposite sides of a stem 916. A number of holes 917 (in this example, three) may be drilled longitudinally into the stem 916 as shown, once the sub-frame 710 has been cut to size. The holes 917 may be threadingly engaged by screws (not shown) that have been driven in from an abutting perimeter sub-frame (e.g., the jamb sub-frame 610, see FIG. 6), to attach the mullion sub-frame 710 to the perimeter sub-frame. The T-shaped cross-section also has a hat 918. As an example, the height of the hat 918 may be about 2.5 inches; the other dimensions of the T-shaped cross-section may then be easily determined since the illustration in FIG. 9 is to scale.

The mullion sub-frame 710 may be manufactured with a thermal break 920 formed in the stem 916 as shown. This particular embodiment has a cavity DD type thermal break by Indalex West Inc. of Modesto, Calif. The thermal break is made of a material that helps improve thermal insulation for the frame. The thermal break 920 serves to act as a thermal barrier between the threat side and the safe side, and is particularly useful when used with thermally insulated glazing units for improved overall thermal insulation. The thermal break may also help reduce the chance of creating condensation on the safe side of the frame. Examples of thermally insulated glazing units are those that have two panes of glass separated by a ¼ inch to 1¼ inch air gap, for example.

Figure 10:
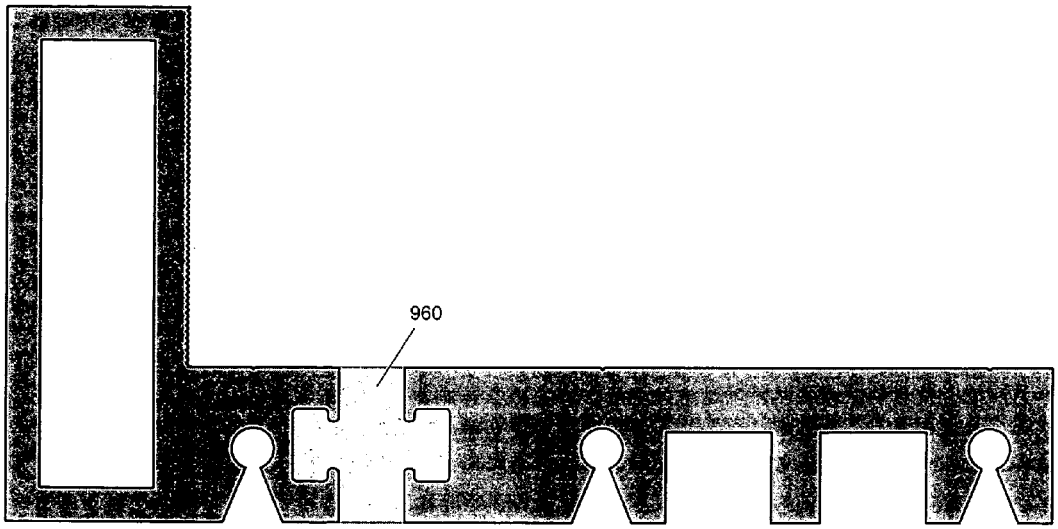
FIG. 10 is a sectional view of a head, jamb, or sill (perimeter) sub-frame with a thermal break formed therein.

The thermal break 920 may be formed in the stem 916 by modifying an aluminum extrusion fabrication process, as follows. First, modify the extrusion equipment so that a hole (that corresponds to the outline of the thermal break 920) is first formed as the sub-frame 710 is extruded. This hole should preferably have an opening on one side of the stem 916, only. This allows the hole to be filled with a liquid material such as a rubberized elastomer in accordance with American Architectural Manufacturers Association AAMA TIR-A8-90 Structural Performance Poured and Debridged Framing Systems, or other material suitable for making a thermal break. The liquid may then be allowed to cool or otherwise transform itself into a relatively solid, thermal break material. Next, the bottom side of the hole that has just been filled can be cut out, thereby isolating the hat section 918 completely from the stem 916. The hat 918 and the stem 916 are then held fixed relative to each other, by the thermal break 920. Other techniques for manufacturing a thermal break in the sub-frame 710 may alternatively be used. Preferred are those that allow some flexure as opposed to a rigid type so that the frame may bend, to better withstand a blast attack. A similar thermal break 960 may also be manufactured into a head, jamb, or sill sub-frame, as depicted in FIG. 10.

In the embodiment shown in FIG. 9, the mullion sub-frame 710 has a cavity or pocket 924 formed in the stem 916 that runs lengthwise along a substantial part of the elongated portion of the mullion sub-frame 710. The cavity 924 may be shorter or longer than shown. For example, the cavity may be longer so as to eliminate the middle hole 917. The cavity 924 is sized to receive a reinforcing strip or bar 928 that can be inserted into the cavity 924 during assembly of the frame at the job site. The use of such reinforcing bars will provide increased protection from ballistic and other threats. For example, the sub-frame may be made from extruded aluminum or other material that has relatively low ballistic resistance as compared to, for example, certain types of steel or ballistic grade aluminum (which have more alloy content and are accordingly less suitable for extrusions). To provide a weather seal, the reinforcing strip 928 may be coated with a liquid sealant/adhesive prior to being inserted into the cavity 924. The sealant once cured should be of a low modulus type, i.e. allow for about a 40-50% increase in size before breaking, to help ensure a long term weather seal.

Still referring to the sectional view of sub-frame 710 shown in FIG. 9, the hat 918 of the T-shaped cross-section may be provided with a further cavity 930 that also runs lengthwise. The cavity 930 may be particularly helpful in reducing the weight of the mullion sub-frame 710 (just as the cavity 316 may serve the same purpose in the sub-frame 204, shown in FIG. 3). The cavity 930 in the mullion sub-frame 710 may also serve to house a further reinforcing block or sleeved armor grade material, to be described below.

Figure 12:
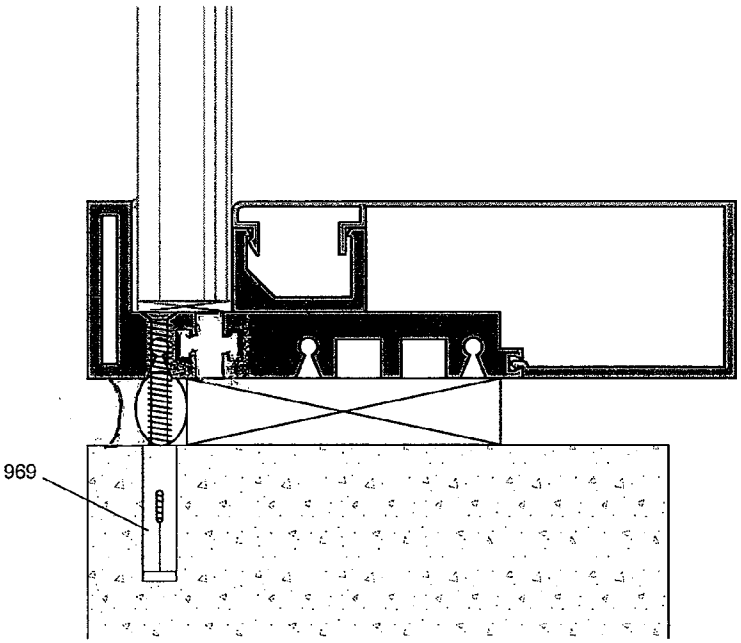
FIGS. 11 and 12 illustrate sectional views of how the perimeter pieces of the frame may be secured to the building material.
Figure 11:
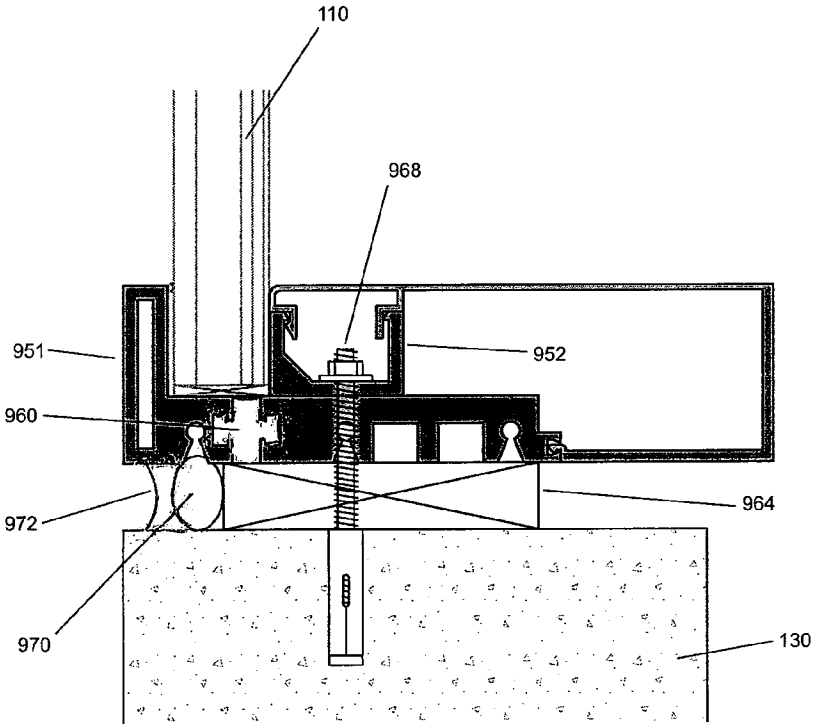
Figure 13:
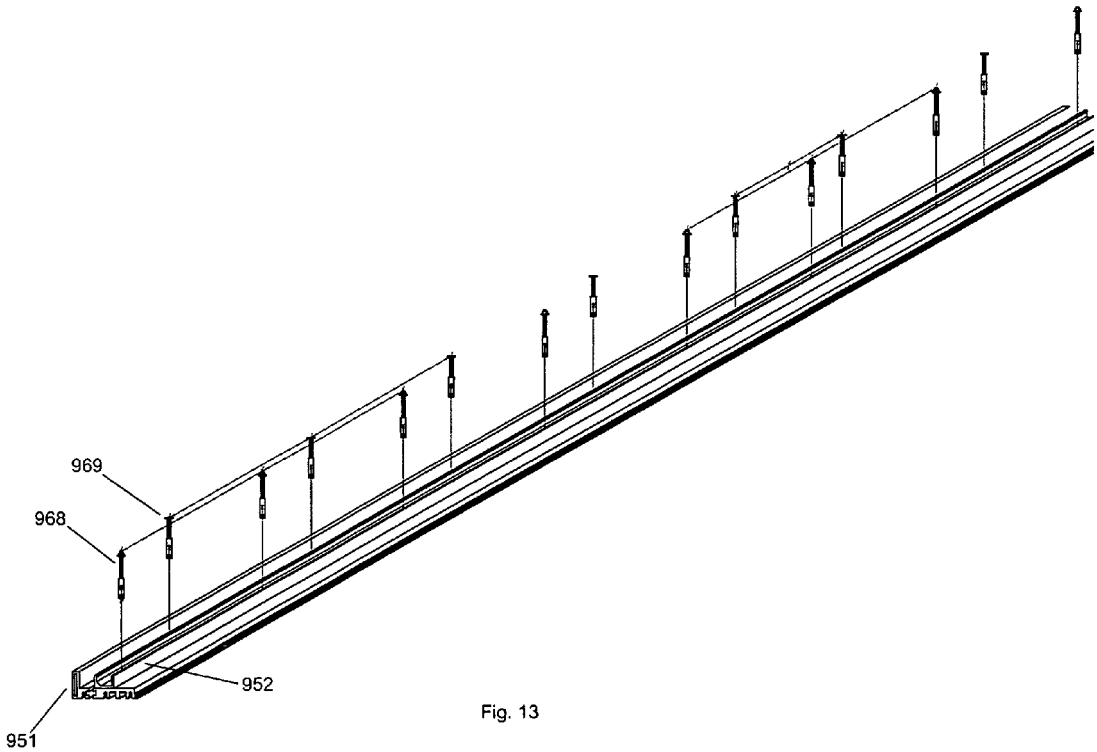
FIG. 13 is a perspective view of a perimeter piece having a sub-frame and a base, secured with multiplesleeve anchors to in this example concrete building material.

Having described some examples of the different embodiments of the structural components or pieces that make up the primary frame, FIGS. 11 and 12 illustrate different ways of securing or anchoring the pieces to the building material. Recall that in FIGS. 2 and 5-8, the sub-frame pieces were secured directly in contact with the building material 130 (being concrete in that case), using concrete or masonry anchors. FIG. 11 shows a sectional view of another way in which a perimeter sub-frame 951 is anchored. Here, the sub-frame has a thermal break 960 formed therein. The sub-frame 951 in this case rests against a setting block 964. The setting block may be an Ethylene Propylene Diene Monomer (EPDM) block or other synthetic rubber membrane that serves as a buffer to help prevent failures due to vibration in the building, and may also serve as a shim. The setting block 964 in turn rests against a substrate or building material 130 being some form of concrete or masonry in this case. The glazing unit 110 is held in place in the corner of the sub-frame 951 by a base 952 which itself is secured by multiple evenly spaced (lengthwise) sleeve anchors 968. The sub-frame 951 itself is also anchored to the building material 130, using a different set of evenly spaced sleeve anchors 969, as shown in FIG. 12. A perspective view of such a perimeter piece is given in FIG. 13, where it can be seen that there are two rows of sleeve anchors. One set of sleeve anchors 968 secure the base 952, and another set of sleeve anchors 969 are screwed into the building material 130 to secure the sub-frame 951. The sleeve anchors may be ⅜ inch masonry type anchors, and their anchoring distances may be selected as a function of the expected type of threat and threat level.

Figure 14:
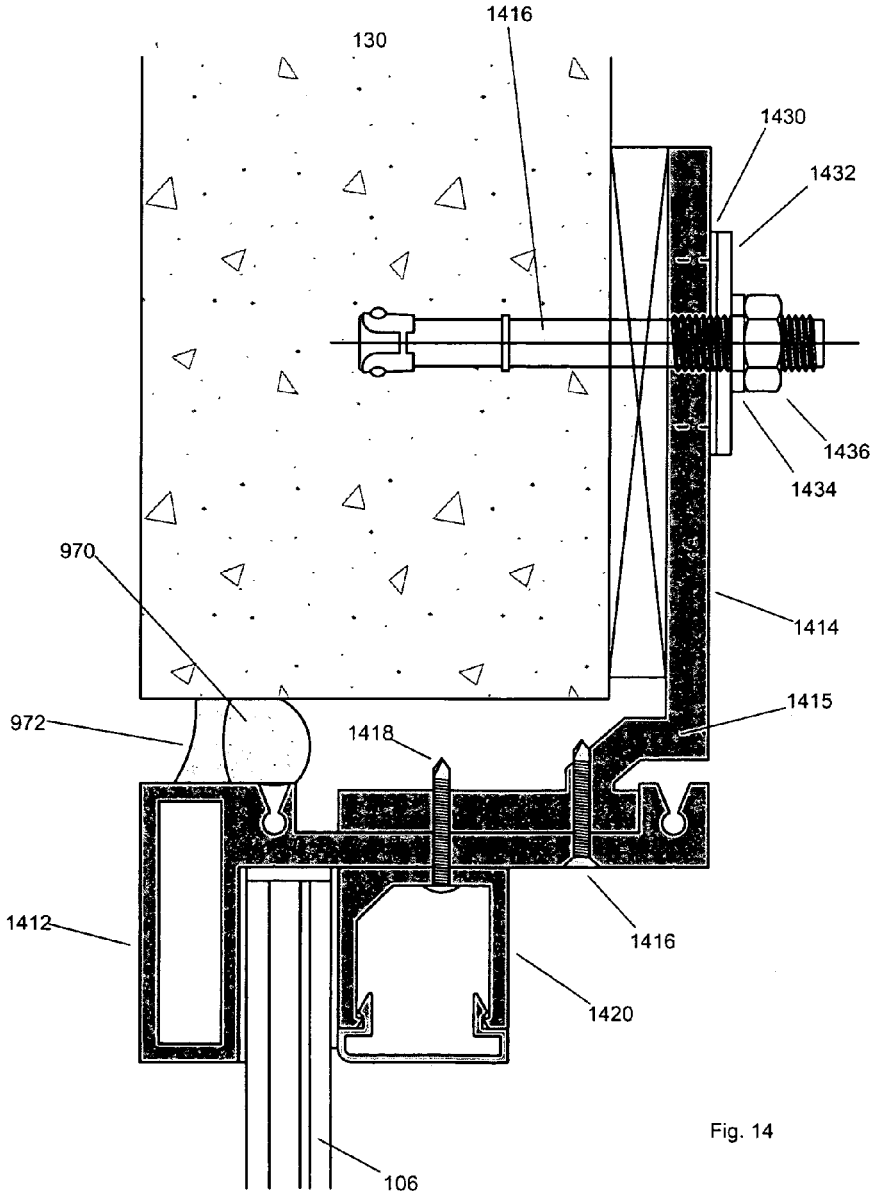
FIG. 14 shows a sectional view of a perimeter sub-frame that is secured to the building material using a secondary anchoring system.

Recall, once again, the elevation view shown in FIG. 1 of the assembled primary frame. This frame may be a "punch" type frame, such as used in a single or (as shown in FIG. 1) multiple pane window. Another alternative is to use the above-described pieces of the framing system for a curtain wall application. For example, FIG. 14 shows a cross-section view of a perimeter sub-frame 1412 that is secured to building material 130 using a secondary anchoring system 1414. The system 1414 is an example of an expansion anchor, and consists of an L-shaped bracket 1415 that is secured, on one segment, to the building material 130 via large masonry or concrete anchors 1416. The bracket 1415 may be a piece of extruded, 6061-T6 aluminum. In this example, the bracket 1415 is secured by the illustrated combination of a NYLOTRON washer 1430 sandwiched between an aluminum bracket 1415 and a steel washer 1432 (to help prevent electrolysis between the dissimilar metals), followed by a lock washer 1434, and a nut 1436. Other techniques for mechanically attaching the bracket 1415 to the building material 130 may be used.

Another segment of the bracket 1415 serves as the securing point for the sub-frame 1412. In this embodiment, a number of flat head screws 1416, that may be equally spaced lengthwise, are installed along the sub-frame to secure the sub-frame 1412 to the L-shaped bracket 1415. Another set of screws 1418 are used to secure the base 1420, also to the L-shaped bracket 1415, so as to secure the glazing unit 106 against its corner in the sub-frame 1412. As in the embodiments shown in FIGS. 11 and 12, additional weatherproofing may be provided by a layer of caulking 972 that is in contact with a high density foam backer rod 970 (used to fill a void prior to filling the caulking). Once again, the spacing of the screws 1418 and 1416 (lengthwise along the elongated portion of the sub-frame 1412 and base 1420) should be selected so as to meet the expected threat and/or threat levels.

Figure 15:
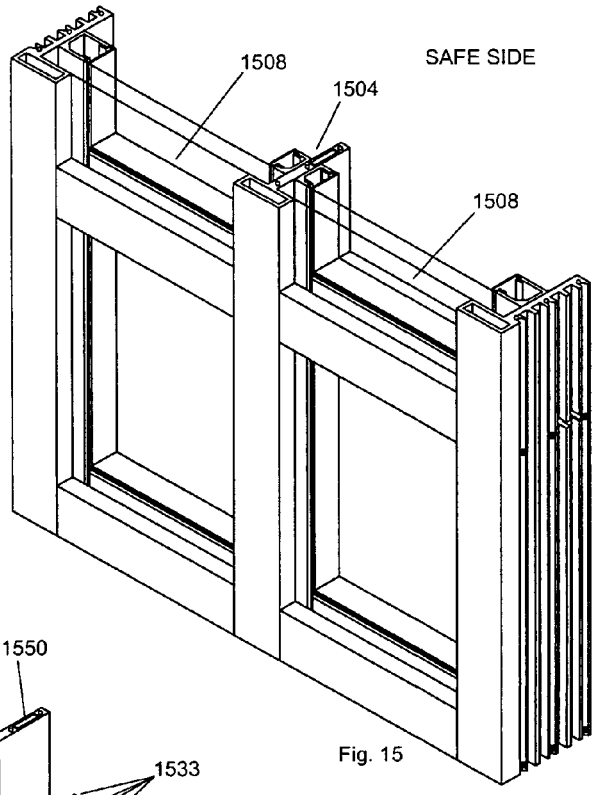
FIG. 15 shows a perspective cut-a-way view of a primary frame having a reinforced vertical mullion and a reinforced horizontal mullion.
Figure 16:
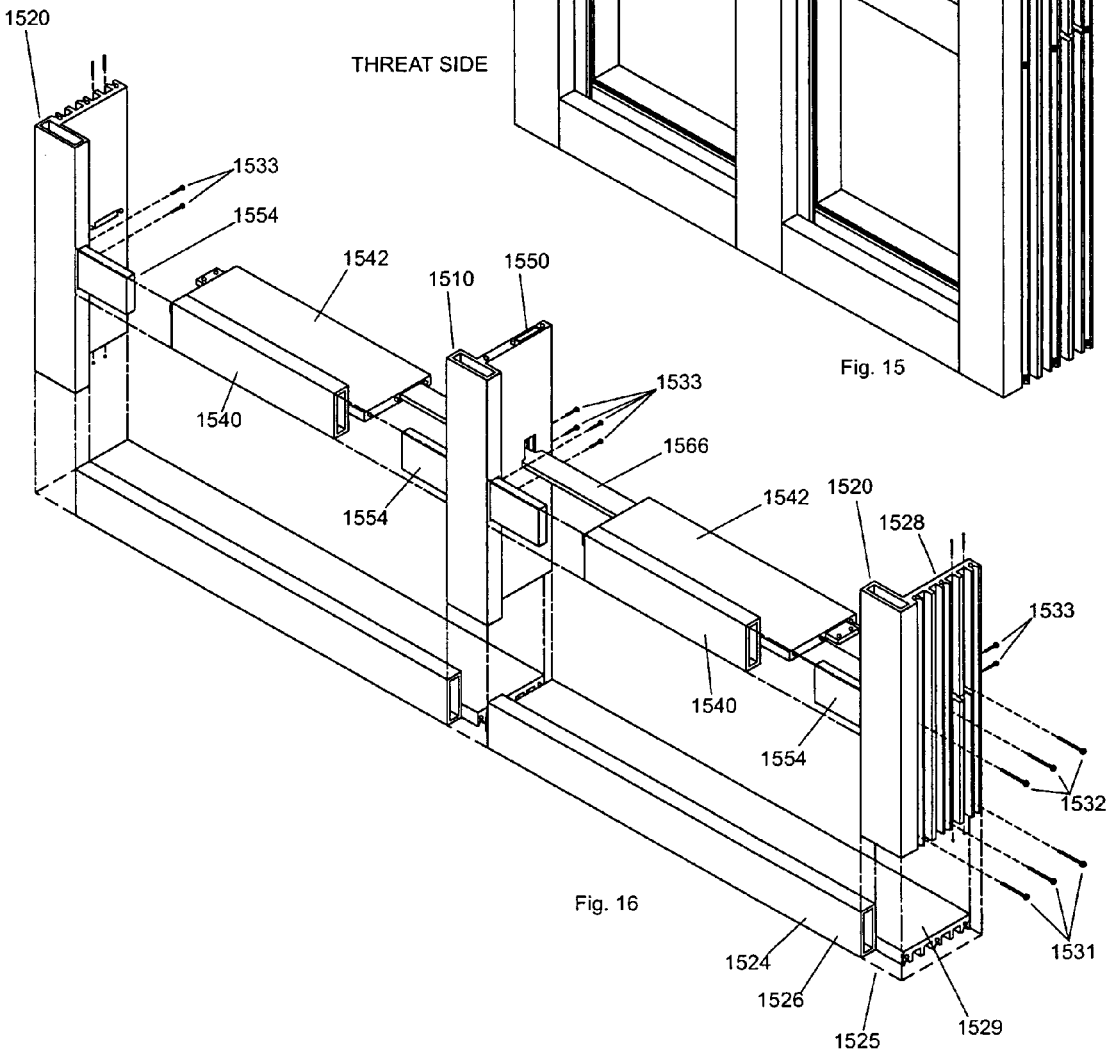
FIG. 16 shows an exploded view of the primary frame shown in FIG. 15.

Turning now to FIG. 15, a perspective cut-a-way view of a primary frame is shown having a reinforced vertical mullion 1504 and a reinforced horizontal mullion 1508. FIG. 16 is an exploded view of FIG. 15. The view shows how the different pieces may be attached to each other to form the frame. For example, in FIG. 16, a jamb sub-frame 1520 abuts a sill sub-frame 1524. A cut out 1525 in the first segment 1526 of the sill sub-frame 1524 allows the second segment 1528 of the jamb sub-frame 1520 to abut against the second segment 1529 of the sill sub-frame 1524. A set of screws 1531 are passed through drilled holes in the segment 1528 and threadingly engage preformed, corresponding holes in the segment 1529. Another set of screws 1532 may be installed in a similar manner, to secure the segment 1528 to the segment 1542 of a horizontal mullion sub-frame.

In this embodiment, a vertical mullion sub-frame 1510 (as well as perhaps the mullion base, not shown) is made of a continuous piece of extruded aluminum that is preferably of the 6063-T5 grade. Similarly, the horizontal mullion sub-frames are essentially made of extruded, 6063-T5 aluminum. As such, they may not provide sufficient ballistic protection at elevated threat levels, unless additional reinforcing strips are installed. The horizontal mullion sub-frame is composed of a vertical segment 1540 and a horizontally oriented segment 1542. Note that in FIG. 16, the bases (that secure the glazing units in place) are not shown so as to emphasize the reinforcing strips.

Still referring to FIG. 16, one form of reinforcing strip used is a sleeve 1550 that is inserted into a cavity in the stem portion of the vertical mullion sub-frame 1510. The sleeve 1550 may protect against ballistic threats that impinge in between adjacent glazing units, as indicated by the arrow in FIG. 15. As described above with respect to FIG. 9, the sleeve 1550 should be coated with an adhesive/sealant before being inserted into the cavity, to provide a weather seal. The adhesive may also act to glue the sleeve 1550 in place inside the cavity.

Another type of reinforcing strip that may be used is a block 1554 that is passed through a pair of slots that are formed on opposite sides of the hat section of the vertical mullion sub-frame 1510. Block 1554 should preferably be long enough to extend beyond both ends of the hat as shown, once inserted into position, so that the segments 1540 of horizontal mullions can be held in place by sliding them over the block. Once again, an adhesive/sealant material should be applied to the block before inserting the block 1554 into position inside the mullion sub-frame 1510. In addition, adhesive/sealant material should be applied to the block 1554 prior to sliding the segment 1540 of a horizontal mullion sub-frame onto the block 1554. The block 1554 may be mechanically attached to a sub-frame 1520 or 1510 by screws, e.g. screws 1533. As such, the blocks 1554 also serve to attach the horizontal mullions to perimeter pieces.

The block 1554, which is also referred to as a shear block because it serves to reinforce against lateral shear (e.g., from a blast attack), may be made of 6061-T6 aluminum or another suitable material. On the other hand, the vertically oriented sleeve 1550 should preferably be made of steel, such as A36 steel, although once again, other suitable materials may alternatively be used. Note that similar shear blocks 1554 are inserted into corresponding slots that have been cut into the jamb pieces 1520 as well.

Figure 17A:
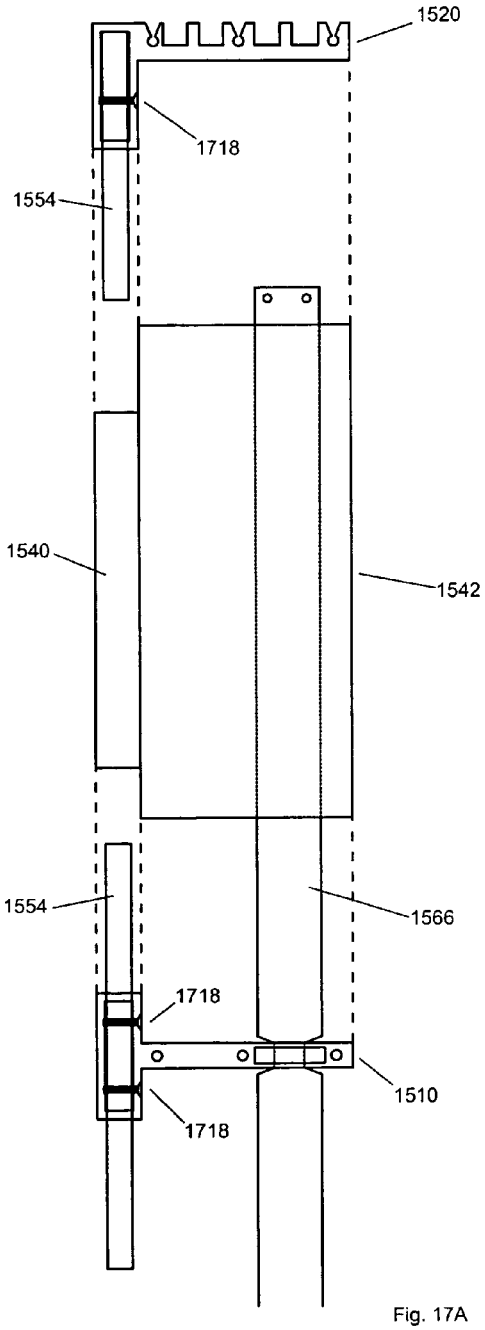
FIG. 17A is a plan view of a section of the primary frame in FIG. 16.

Another type of reinforcing material, shown in FIG. 16, is a notched reinforcing strip 1566. The strip 1566 serves to reinforce against lateral shear, as well as protect against ballistic threats that impact in between glazing units. Installation of the strip 1566, in this embodiment, needs not only the cavity (shared by the sleeve 1550) but also a pair of slots that are formed on opposite surfaces of the stem of the mullion sub-frame 1510. These slots are positioned relative to the cavity in the stem, so that the strip can be passed through the pair of slots when held vertically. Then, once the notch or cut-out is positioned in the cavity (of the stem of the sub-frame 1510), the strip 1566 is rotated about 90 degrees into a horizontal position as shown. This essentially locks the strip 1566 in place within the sub-frame 1510 (due to the notched cut-out), thereby avoiding the need for additional fasteners to secure the strip at the sub-frame 1510. FIG. 17A shows a plan view of how the strip 1566 appears when it has been passed through the pair of slots in the stem of the mullion sub-frame 1510, and through the segment 1542 of another mullion sub-frame. The plan view also shows how the other segment 1540 slides onto blocks 1554. Note the use of fasteners 1718 to secure the blocks 1554 to the mullion sub-frames 1510 and 1520 so as to prevent their horizontal movement.

Figure 17B:
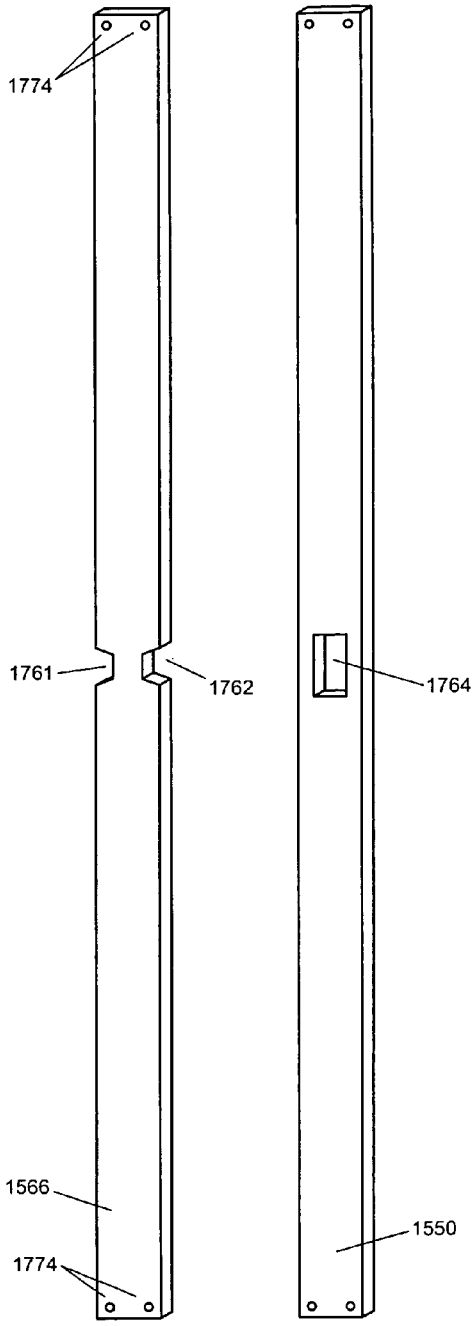
FIG. 17B is a plan view of an interlocking strip and sleeve.

The plan view of FIG. 17B shows an example of the relative dimensions of the strip 1566 (including its angled notches 1761, 1762) and the sleeve 1550 (having a slot 1764). The slot 1764 is sized to allow the strip 1566 to be passed there through while vertical, and then press fitted into position after being rotated to the horizontal (as in FIG. 17A). The angled (as opposed to perpendicular) walls of the notches 1761, 1762 permit the strip 1566 to in effect wedge itself against the walls of the slot 1764 in the sleeve 1550 and the walls of the pairs of slots in the stem of the mullion sub-frame 1510 (see FIG. 16).

Figure 18:
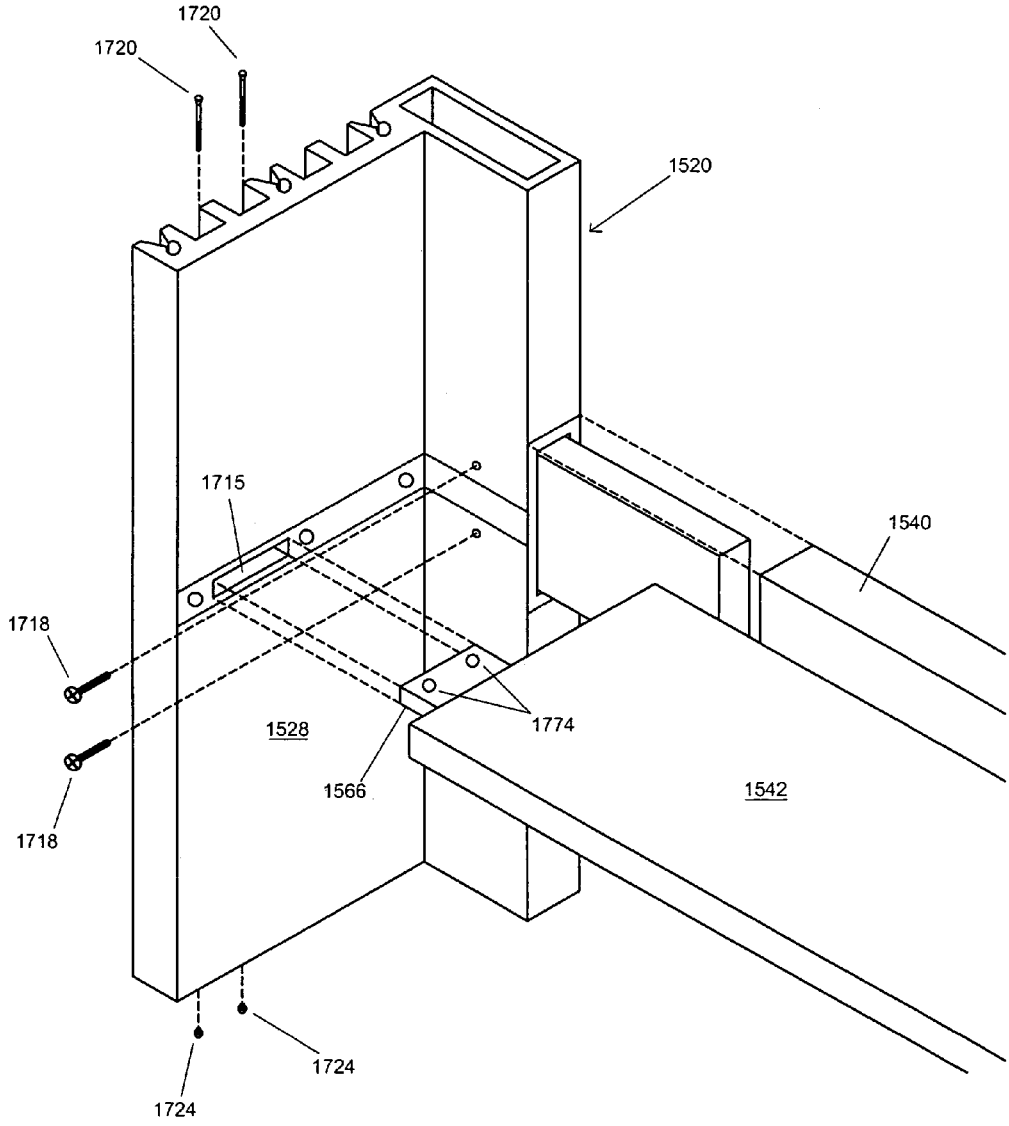
FIG. 18 is an enlarged view of how a mullion may be joined to a perimeter piece.

FIG. 18 illustrates how mullion sub-frame segments 1542 and 1540 may be secured to the perimeter sub-frame 1520. In addition to the fasteners 1718 (e.g., anchor screws) which are also shown in FIG. 17A, this embodiment calls for a slot 1715 to be cut through the segment 1528 of the perimeter sub-frame 1520. An end of the strip 1566 is then inserted therein from the front side of the segment 1528. A pair of wedge anchors 1720 are then passed through corresponding pre-drilled holes 1774 in the end of the strip 1566, on the back side of the segment 1528, so as to prevent the end of the strip 1566 from sliding out the front. The wedge anchors 1720 may be further held in place using nylon lock nuts 1724. Other screw spline techniques for joining and securing a mullion sub-frame to a perimeter sub-frame, rather than welding joints together, may alternatively be used.

Figure 19:
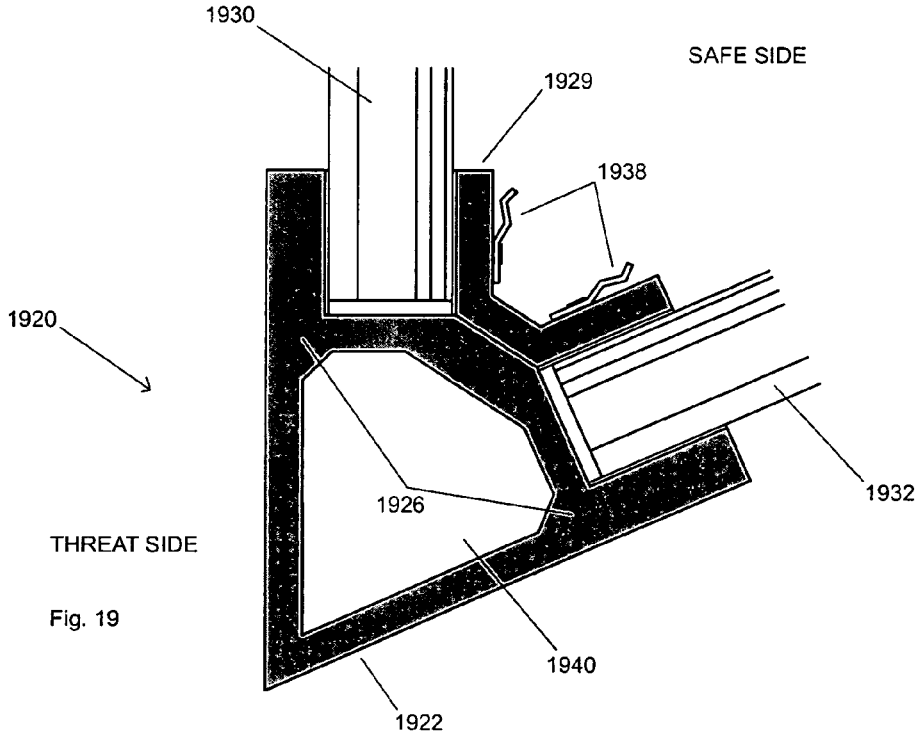
FIGS. 19-20 are sectional views of corner pieces that may be used to traverse an angle.
Figure 20:
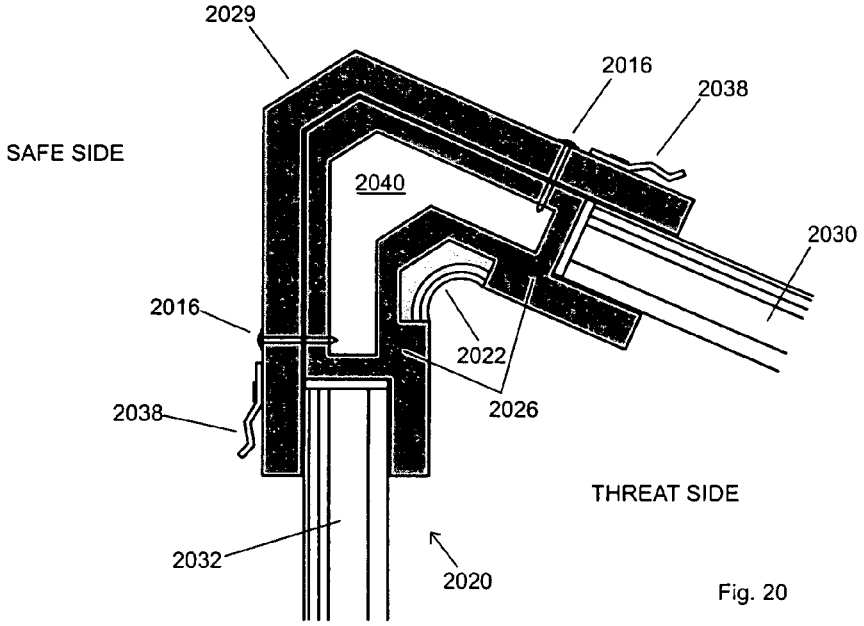

Turning now to FIGS. 19-20, these show sectional views of two different types of primary corner pieces that may be used to achieve a more desirable, architecturally cleaner look for a primary frame that has to traverse at an angle in the building. Compare FIGS. 15-16 where the frame does not traverse at an angle. The corner pieces obviate the need to modify the perimeter pieces described above, to traverse at an angle. These may also be preformed and cut from a single beam of extruded aluminum.

FIG. 19 shows a threat-side, primary corner piece 1920 (so named because a corner 1922, once installed, is located in the threat side, as opposed to the safe side of the frame). The piece 1920 has a pair of corner regions 1926 that are sized and located with respect to each other so as to receive therein separate glazing units 1930, 1932, as prescribed by the angle to be traversed. A glass-stop 1929 is placed against the glazing units from the safe side as shown, and is then secured to the area of the piece 1920 that is between the corners 1926, using for example screw anchors that are spaced lengthwise along the elongated portion of the corner piece (not shown). Clips 1938 may be riveted to the exposed side of the glass-stop 1929 as shown, to secure an aesthetic cover cap in place (not shown). To reduce weight, a cavity 1940 may be formed that runs lengthwise, through a substantial part of an elongated portion of the piece 1920. In addition, armor material may be sleeved therein to further resist a ballistic attack in situations where the corner piece 1920 is not made of an armor grade material.

FIG. 20 shows a safe-side, primary corner piece 2020 (so named because a corner 2022, once installed, is located in the threat side, as opposed to the safe side of the frame). The piece 2020 has a pair of corner regions 2026 that are sized and located with respect to each other as prescribed by the angle to be traversed, and receive therein separate glazing units 2030, 2032 from the safe side. A glass-stop 2029 is placed against the glazing units as shown to secure them in their respective corners. The glass-stop 2029 is then secured to the piece 2020 using for example screw anchors 2016. Clips 2038 may be riveted to the glass-stop 2029, to secure an aesthetic cover cap in place (not shown). To reduce weight, a cavity 2040 may be formed that runs lengthwise, through a substantial part of an elongated portion of the piece 2020. As with the cavity 1940, armor material may be sleeved in the cavity 2040 to better resist a ballistic attack in cases where the corner piece is not made of armor grade material.

Installation Techniques

There are several different manufacturing and assembly processes that may be followed to install the different embodiments of the primary frame described above, as part of a security window installation. For example, in the so-called kit technique, the individual sub-frame and base pieces are measured and pre-cut from their respective extruded aluminum beams at the factory (and all or most of the holes are pre-drilled) according to a standard or specially ordered specification. They are then shipped as a combination of mostly loose pieces with perhaps some partially assembled framing sections to the job site, i.e. mostly unassembled. This allows some final trimming and adjustments, if needed, to be easily made to each piece at the job site. Next, the perimeter sub-frame pieces are affixed to the building material at the job site, using for example the fastener mechanisms described above. The resulting sub-frame assembly may also include a mullion sub-frame that is attached to a perimeter sub-frame. Next, a glazing unit is placed in the sub-frame corners of the assembly. This may be preceded by the application of adhesive tape or liquid to the vertical sub-frame segments. Finally, the base pieces are placed up against the glazing unit and the horizontal sub-frame segments, and may then be secured in place using a fastener mechanism. Aesthetic caps may then be positioned in place, to complete the installation of the security window.

Another manufacturing and assembly process is referred to as the "knock down" technique. In that case, substantially all of the perimeter sub-frame pieces (as well as mullion sub-frames, if any) are attached to each other at the factory into a sub-frame assembly unit. This unit is then shipped to the job site. Next, the sub-frame assembly unit is affixed into its opening at the job site (using a fastener mechanism). The rest of the operations described above for the kit technique may then be followed, starting with placement of the glazing unit in the corners of the sub-frame assembly, to complete the security window installation.

In still another technique, one or more glazing units are placed in the corners of the sub-frame assembly unit at the factory and are held in place, e.g. by adhesive tape or liquid. The base pieces are then put in place against the glazing unit, and are secured to the sub-frame pieces by for example, a set of screws, thereby forming a combo unit (having the combination of frame pieces and a glazing unit). Note that the fasteners used to secure the base pieces for the combo unit may be separate from the primary fasteners that will secure the base to the building material (e.g., screws 216 in FIG. 2). In this unitized approach, the combo unit is then shipped to the job site, where it is then fitted into its opening. Primary fasteners are then applied (through the predrilled holes in the perimeter bases) to secure the combo unit to the building material. In this case, most, if not all, of the fasteners described above that secure the perimeter sub-frames to the building material (separate from the base), e.g. screws 212 in FIG. 2, are not applied. This embodiment may be particularly desirable for buildings that call for a large number of security windows, due to its relatively short installation time. For example, such a technique may be desirable in the construction of high-rise buildings where a crane may be available to lift the relatively bulky and heavy combo units to the upper floors for installation.

To summarize, various embodiments of a primary framing system with preformed pieces have been described. In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A window framing system, comprising:

a plurality of pieces that are structural components of a primary frame, wherein the pieces include a sub-frame and a base, the sub-frame having a corner to receive a glazing unit, the sub-frame has an elongated portion with an L-shaped cross-section that defines said corner, the L-shaped cross-section having a) a first segment in which there are a first plurality of holes through which the sub-frame is to be secured to one of a head, jamb, and sill at a job site and a plurality of screw holes formed lengthwise through the first segment, the sub-frame capable of being secured to an abutting sub-frame of one of the plurality of pieces through the screw holes, and wherein the screw holes are configured to meet blast mitigation threats per ASTM F 1642-96 standards, and b) a second segment perpendicular to the first segment with a cavity having an enclosed cross-section formed therein that occupies a substantial portion of the second segment and runs lengthwise through a substantial part of the elongated portion, the base to be assembled with the sub-frame so as to secure the glazing unit in the corner.

2. The system of claim 1 wherein the pieces further include a sub-frame, a first base and a second base of a mullion, the mullion sub-frame having respective corners to receive first and second glazing units, respectively, the first and second bases to be assembled with the mullion sub-frame so as to secure the first and second glazing units in the respective corners.

3. The system of claim 2 wherein the mullion is to be horizontally oriented as assembled.

4. The system of claim 2 wherein the mullion is to be vertically oriented as assembled.

5. The system of claim 2 wherein the first and second mullion bases are shorter, in height, than said base.

6. The system of claim 1 wherein each of the screw holes communicates with an opening that allows material which has been cut, due to a screw being driven in the hole, to exit so as not to fill up the hole.

7. The system of claim 1 wherein the base has an elongated portion with an L-shaped cross-section whose first segment lies against the glazing in said corner and whose second segment is to be secured to the sub-frame, the first and second segments lead into a fillet having a chamfer at its corner.

8. The system of claim 6, wherein the first segment of the sub-frame has a second plurality of holes formed laterally in the first segment and through which the sub-frame is to be secured to one of said head, jamb, and sill at the job site by means of a plurality of anchor fasteners.

9. The system of claim 8, wherein some of the second plurality of holes line up directly behind the glazing unit that is installed in the corner, and some others of the second plurality of holes line up directly behind corresponding holes in the base through which anchor fasteners are to be passed for securing the sub-frame to one of said head, jamb, and sill at the job site.

10. The system of claim 1 wherein each of the sub-frame and the base is essentially made of a continuous piece of extruded aluminum.

11. The system of claim 1 wherein the first segment of the sub-frame is of extruded aluminum with a thermal break formed therein.

12. The system of claim 2 wherein the mullion sub-frame has an elongated portion that has a substantially T-shaped cross-section in which the respective corners are on opposite sides of a stem.

13. The system of claim 12 wherein the stem has a cavity that runs lengthwise along a substantial part of the elongated portion, the system further comprising a reinforcing strip sized to be inserted into the stem cavity.

14. The system of claim 12 wherein the stem has (i) a cavity therein that runs lengthwise along a substantial part of the elongated portion, and (ii) a pair of slots formed in its outside surface, the system further comprising a notched reinforcing strip, wherein the pair of slots are positioned relative to the cavity and are sized relative to the strip so that the strip can be passed through the pair of slots and a notched portion of the strip can be locked into position in the cavity between the pair of slots.

15. The system of claim 12 wherein the mullion sub-frame has a cavity that runs lengthwise though a hat of the T-shaped cross-section.

16. The system of claim 15 wherein the sub-frame has a pair of slots on opposite ends of the hat, the system further comprising:

a block sized to be inserted into the cavity through the pair of slots and being long enough to extend beyond both said ends of the hat when inserted; and an intermediate mullion piece that is sized to receive a portion of the block therein.

17. A window framing system, comprising:

a plurality of pieces that are structural components of a primary frame, wherein the pieces include a sub-frame and a base, the sub-frame having a corner to receive a glazing unit, the sub-frame has an elongated portion with an L-shaped cross-section that defines said corner, the L-shaped cross-section having a) a first segment in which there are a first plurality of holes through which the sub-frame is to be secured to one of a head, jamb, and sill at a job site and a plurality of screw holes formed lengthwise through the first segment, the sub-frame capable of being secured to an abutting sub-frame of one of the plurality of pieces through the screw holes, and wherein the screw holes are configured to meet blast mitigation threats per ASTM F 1642-96 standards, and b) a second segment perpendicular to the first segment, the first segment and the second segment integrally formed with one another, the base to be assembled with the sub-frame so as to secure the glazing unit in the corner.

18. The system of claim 17, wherein the second segment includes a cavity having an enclosed cross-section formed therein that occupies a substantial portion of the second segment.

19. The system of claim 17, wherein each of the sub-frame and the base is essentially made of a continuous piece of extruded aluminum.

* * * * *